US005639027A

United States Patent [19]

Fritz

[11] Patent Number: 5,639,027

[45] Date of Patent: Jun. 17, 1997

[54] TWO COMPONENT EXTERNAL MIX SPRAY GUN

[75] Inventor: Alan H. Fritz, Toledo, Ohio

[73] Assignee: Ransburg Corporation, Indianapolis, Iowa

[21] Appl. No.: 351,932

[22] Filed: Dec. 8, 1994

[51] Int. Cl.[6] ..... B05B 7/04; B05B 7/08

[52] U.S. Cl. ..... 239/414; 239/433

[58] Field of Search ..... 239/296, 424.5, 239/424, 423, 422, 428, 433, 413, 414

[56] References Cited

U.S. PATENT DOCUMENTS

| | | | |
|---|---|---|---|
| 2,958,471 | 11/1960 | Zippel | 239/414 |
| 2,970,773 | 2/1961 | Keryluk et al. | 239/414 |
| 3,087,682 | 4/1963 | Peeps | 239/414 |
| 3,229,911 | 1/1966 | Carlson et al. | 239/414 |
| 5,209,405 | 5/1993 | Robinson et al. | 239/296 |
| 5,400,971 | 3/1995 | Maugans et al. | 239/433 |

*Primary Examiner*—Matthew C. Graham
*Attorney, Agent, or Firm*—MacMillan, Sobanski & Todd

[57] ABSTRACT

A two component external mix spray gun having a pneumatically operated valve for controlling the injection of a catalyst into pattern shaping air passages in the gun. The catalyst is contacted with the atomized fluid externally to the spray gun. A trigger sequentially operates air and fluid valves to provide atomization air and pattern shaping air prior to opening the fluid valve. The pneumatic catalyst valve is responsive to an increase in the air pressure downstream from the air valve to inject the catalyst into the pattern shaping air prior to the opening of the fluid valve. The catalyst impinges on the atomized fluid eternally to the spray gun along with the pattern shaping air. The invention may be incorporated in either a hand held spray gun with a manual trigger or an automatic spray gun with a controller.

10 Claims, 2 Drawing Sheets

TWO COMPONENT EXTERNAL MIX SPRAY GUN

TECHNICAL FIELD

The invention relates to spray guns and more particularly to an improved spray gun for applying two component materials in which a catalyst or activator is added to a primary material such as an adhesive or a paint.

BACKGROUND ART

In the past, sprayable paints and adhesives frequently have been organic solvent based. The solvent is used to maintain the material in a sufficiently fluid state to permit spraying. Organic solvents were selected to achieve rapid drying. As the sprayed material dries, solvent enters the atmosphere and can be hazardous. Recently, there has been an increasing demand for two component materials in which a water born coating or adhesive material is chemically hardened or activated through the use of a separate catalyst or activator. As used hereinafter, the term "catalyst" will be used generically to describe any catalyst or activator or other type of chemical which is added to a coating material to promote a change in the material. Some types of adhesive and other types of coating materials, such as epoxy type materials, may have a relatively long pot life after mixing with a catalyst. The long pot life permits mixing the components either prior to delivery to a spray gun or internally in the spray gun. The pot life of the mixture is sufficiently long as to permit cleaning the spray gun after spraying. Other types of two component materials must be mixed externally to the spray gun, since there is not a sufficient pot life of the mixture to permit easy cleaning of the spray gun after the material is mixed or contacted with the catalyst.

In prior art spray guns for externally mixed two component materials, the coating or adhesive material is sprayed from a modified conventional spray gun. The spray gun has been modified by mounting a mechanically operated catalyst valve on the gun. The catalyst valve has been mounted towards the rear of the spray gun body where it is easily connected through linkages to be operated by the existing spray gun trigger. The linkages are adjusted to open the catalyst valve immediately prior to opening the fluid valve for the coating or adhesive material. This assures that all sprayed material will be exposed to catalyst. In one prior art spray gun, the catalyst valve was connected through a small tube to spray the catalyst at the atomized fluid at a point downstream from an air cap. In this arrangement, the catalyst was sprayed only at one side of the atomized fluid envelope. Consequently, the atomized fluid was not uniformly exposed to the catalyst. The material spaced furthest from the catalyst nozzle was not necessarily exposed to sufficient catalyst, resulting in a defective application of paint or adhesive. In an improved prior art gun, the catalyst was injected into a pattern shaping air chamber in the air cap or upstream from the air cap for mixing with the pattern shaping air. This arrangement provides superior contact between the catalyst and the atomized material immediately downstream from the spray gun nozzle. However, there have still been some problems with this arrangement. Because the valve has been located at or near the rear end of the gun body in order to connect the operating linkages to the trigger, a relatively long tube is used to deliver the catalyst from the valve to the pattern shaping air chambers. When the gun is shut off and set down, catalyst in the tube sometimes has drained into the pattern shaping air chamber. This can result in a burst of catalyst in the pattern shaping air when the spray gun is first triggered. Also, the linkages connecting the catalyst valve to the trigger have been prone to damage and misadjustment which can result in an improper timing of the opening of the catalyst valve relative to the opening of the main fluid valve.

DISCLOSURE OF INVENTION

According to the invention, an improved two component external mix spray gun is provided with a pneumatically operated catalyst valve mounted adjacent a forward end of the body of a modified conventional spray gun for injecting catalyst into a pattern shaping air chamber where the catalyst is mixed and atomized in the pattern shaping air. The length of the fluid passages between the pneumatic valve and the pattern shaping air chamber where the catalyst is injected is sufficiently short to prevent problems with excessive catalyst draining into the chamber after the spray gun is turned off. The trigger of a conventional spray gun is designed to control both air flow and fluid flow to the gun nozzle. As the trigger is operated, the air flow is initiated prior to the fluid flow to assure that there is a flow of atomization air and pattern shaping air when fluid is delivered to the nozzle assembly. When the trigger is released to terminate spraying, the fluid flow to the nozzle assembly is stopped before the air flow to assure that no unatomized fluid will drip from the nozzle assembly.

According to the invention, air pressure in the gun downstream from the trigger is used to control the catalyst valve. Thus, when the trigger is sufficiently operated for atomization air and pattern shaping air flow to begin, the air pressure opens the catalyst valve to inject catalyst into the flowing pattern shaping air. By using the air pressure downstream from the trigger to control the catalyst valve, the catalyst flow will always be initiated after the air flow has begun and prior to the fluid flow and will always be terminated after the fluid flow is terminated.

Since the catalyst will be injected into a chamber containing pressurized pattern shaping air, the catalyst must have a pressure greater than the air pressure in order to flow into the pattern shaping air chamber. Typically, the catalyst will be located in a pressurized container placed on the floor near the location where the fluid is sprayed. The pressure in the catalyst container must not only be sufficient to overcome the air pressure, but it also must overcome the pressure head created by the maximum height of the spray gun above the container. Since the pressure head may vary during spraying, it is preferable to use a higher catalyst pressure then the minimum required pressure to eliminate pressure head variations. A metering orifice then is placed in the catalyst line near but upstream from the catalyst valve to control the rate that the catalyst is injected into the pattern shaping air.

Accordingly, it is an object of the invention to provide an improved external mix two component spray gun.

Other objects and advantages of the invention will become apparent from the following detailed description of the invention and the accompanying drawings.

BEST MODE FOR CARRYING OUT THE INVENTION

Figure 1:
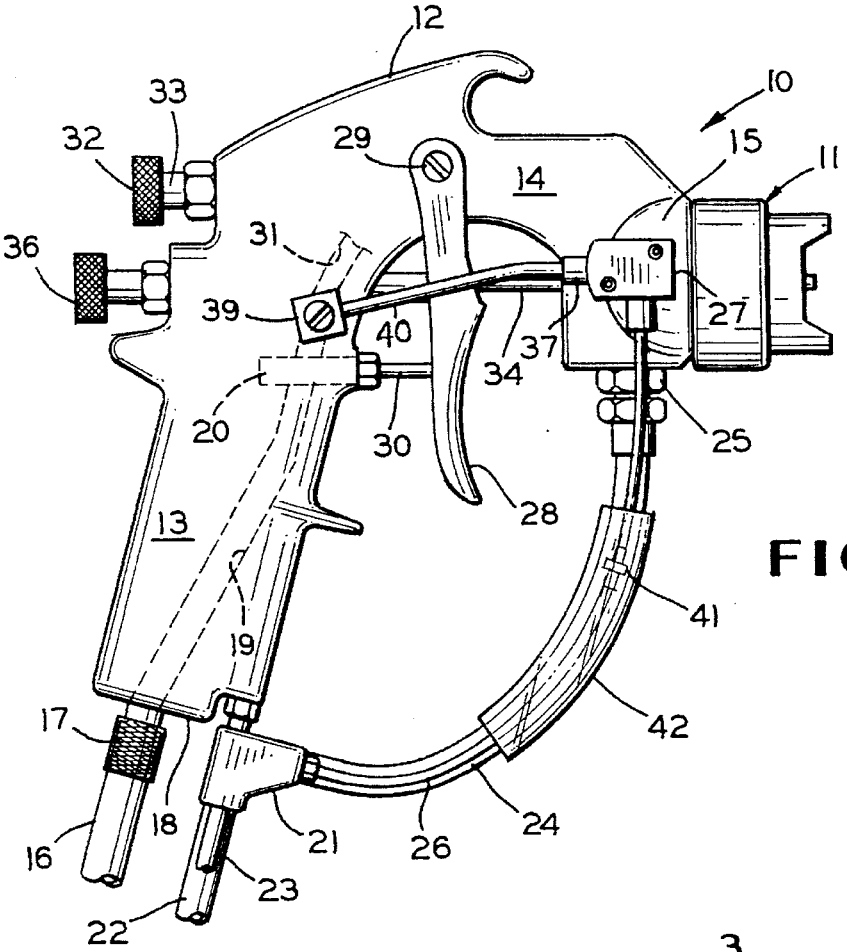
FIG. 1 is a side elevational view of a two component external mix spray gun according to the invention.

Referring to FIG. 1 of the drawings, a spray gun 10 is illustrated according to a preferred embodiment of the invention. The illustrated spray gun 10 is a hand held HVLP spray gun which uses a high volume low pressure flow of atomization and pattern shaping air at a nozzle assembly 11 for atomizing a primary component of a two component material, such as a water borne adhesive, and for spraying such material in a flattened or fan shaped pattern. The invention is illustrated as a modification to the spray gun shown in U.S. Pat. No. 5,209,405, and the disclosure of such patent is incorporated herein by reference. However, it will be appreciated that the invention is equally applicable to a spray gun which uses high pressure air for atomization and pattern shaping and to an automatic spray gun which, for example, is mounted on a fixed stand or on a reciprocator or on an industrial robot for industrial applications. In an automatic spray gun, the trigger operated air and fluid valves are replaced with valves operated by a programmable controller.

The spray gun 10 includes a body 12 having a handle 13, a central portion 14 and a barrel end 15. The nozzle assembly 11 is secured to the barrel end 15. High pressure air from a suitable compressor or shop air line (not shown) is supplied to the gun 10 through a hose 16 which connects to a fitting 17 on a free end 18 of the gun handle 13. Air flows from the fitting 17 through a passage 19 in the handle 13 to a normally closed valve 20. A manifold block 21 also is attached to the handle end 18. A fluid hose 22 and a catalyst hose 23 are connected to the manifold block 21. The three hoses 16, 22 and 23 are all supported from the gun handle end 18 so as to minimize their effect on the balance of the gun 10 during operation. If desired, the hoses 16, 22 and 23 may be connected together, for example, by clips or plastic ties, to help manage the hoses during operation of the spray gun 10. The manifold block 21 has a first internal passage (not shown) which connects the fluid hose 22 to a fluid hose 24 which leads to a fitting 25 on the barrel end 15 of the gun body 12. A second internal passage (not shown) in the manifold 21 connects the catalyst hose 23 to a catalyst hose 26 which is connected to a pilot valve 27. As will be described in greater detail below, when the valve 27 is opened, catalyst is injected into pattern shaping air which impinges on and mixes with the atomized fluid.

A screw 29 secures a trigger 28 to the central portion 14 of the body 12 for pivoting towards and away from the handle 13. As the trigger 28 is squeezed to turn on the spray gun 10, a plunger 30 is moved to open the air valve 20, allowing the compressed air in the passage 19 to flow into a passage 31 which connects to the nozzle assembly 11. The air flow in the passage 31 is divided into two portions: a flow of atomization air for atomizing the fluid from the hose 24 and a flow of pattern shaping air which flattens the envelope of the atomized fluid into a fan shaped pattern. The pressures of the atomization air and of the pattern shaping air are reduced to desired low levels before the air is discharged from the nozzle assembly 11. A knob 32 operates a valve needle 33 to control the flow of pattern shaping air to produce a desired spray pattern. As the trigger 28 is further squeezed after the valve 20 is opened, a valve needle 34 is moved to open a fluid valve 35 (FIG. 2) in the nozzle assembly 11. A knob 36 is provided for adjusting the amount of fluid which will be discharged when the fluid valve 35 is fully opened by limiting the axial travel of the valve needle 34.

The pilot valve 27 is normally closed, inhibiting the flow of catalyst to the nozzle assembly 11. When sufficient air pressure is applied to a control port 37, the valve 27 is opened and catalyst flows into a passage 38 (FIG. 3) in the barrel end 15. A fitting 39 is secured to the handle 13 to connect a hose 40 to the passage 31. An opposite end of the hose 40 is connected to the catalyst valve control port 37. Thus, when the trigger 28 is initially squeezed to open the valve 20 and pressurized air flows into the passage 31, the pressurized air will be applied to the control port 37 to open the catalyst valve 27 and catalyst will be injected into the flowing pattern shaping air. It will be appreciated that the pattern shaping air will be under at least a low pressure as it flows in the spray gun 10. In order to assure that the catalyst is injected into the pattern shaping air, the catalyst in the hose 23 is maintained at a pressure greater than the pattern shaping air pressure at the point of injection plus the maximum pressure head resulting from locating the spray gun 10 above the pressurized catalyst source. A calibrated orifice 41 is placed in the catalyst hose 26 near the valve 27 to limit the flow when the valve 27 is opened. A plastic sleeve or tube 42 may be placed over the hoses 24 and 26 and the orifice 41 for protection and to keep the hoses 24 and 26 together. Alternately, the orifice 41 may be replaced with an in-line flowmeter with an integral needle valve for in-process flow measurement and control.

Internal details of the spray gun 10 and particularly of the nozzle assembly 11 are shown in FIGS. 2–6. The nozzle assembly 11 includes a fluid tip 48, a baffle 49, an air cap 50 and a retaining ring 51. A sleeve 52 is mounted in and projects from a passage 53 in the gun barrel end 15. The sleeve 52 has an internally threaded central opening 54. The fluid tip 48 has a threaded end 55 which engages the threaded sleeve opening 54. The baffle 49 is secured to the spray gun body 12 by clamping between a radial flange 56 on the fluid tip 48 and a front face 57 on the barrel end 15. An annular gasket 58 provides a fluid tight seal between the gun body 12 and the baffle 48. The baffle 48 has a threaded perimeter 59. The retaining ring 51 is threaded onto the baffle 49 to retain the air cap 50 on the spray gun 10.

The fluid to be atomized which is supplied to the barrel end 15 through the hose 24 passes into the opening 54 in the sleeve 52. The fluid valve needle 34 passes coaxially through the opening 54 and an axial chamber 60 in the fluid tip 48 to a tapered end 61 which seals against the fluid tip 48 to form the valve 35. When the trigger 28 is squeezed sufficiently, the valve needle 34 is moved in an axial direction to open the valve 35 and fluid is discharged through the annular orifice formed between the tapered valve needle end 61 and the fluid tip chamber 60.

Figure 2:
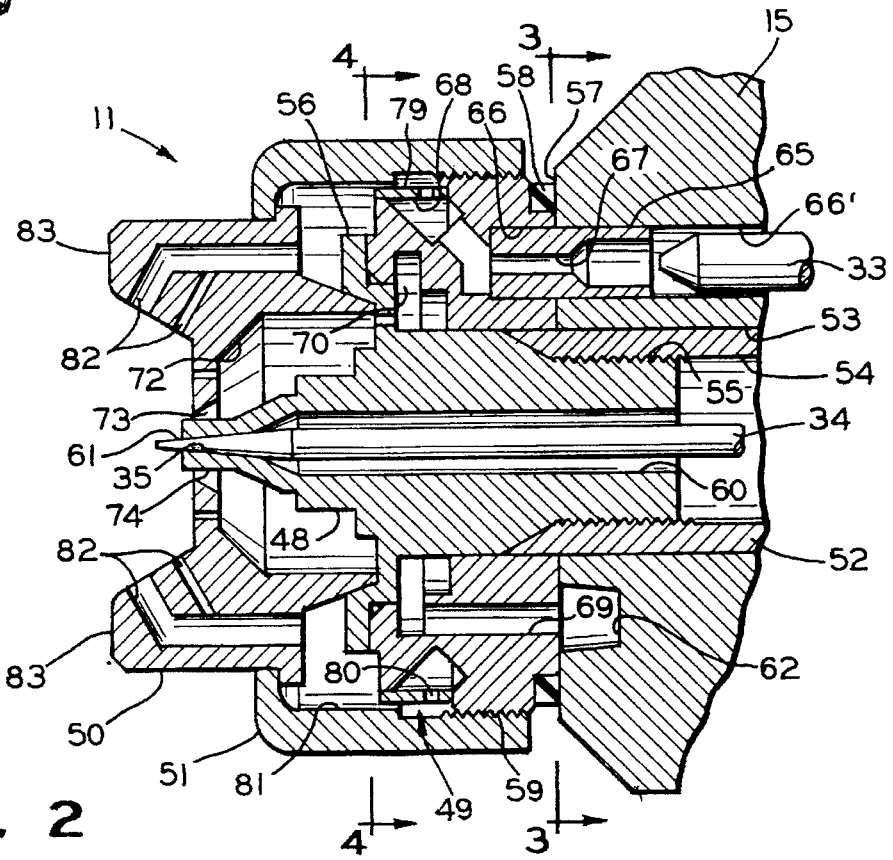
FIG. 2 is an enlarged vertical cross sectional view through the front end of the spray gun body and the nozzle assembly for atomizing fluid.
Figure 4:
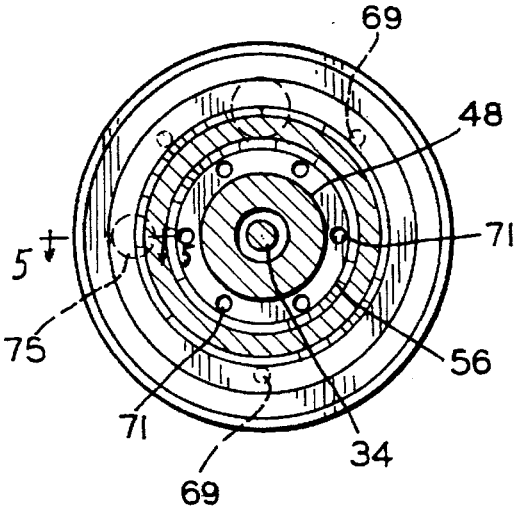
FIG. 4 is a cross sectional view as taken along line 4—4 of FIG. 2.

As best illustrated in FIGS. 2 and 4, an annular groove 62 is formed in the barrel face 57. The passage 31 (FIG. 1) in the spray gun body 14 is split into separate high pressure air passages for atomization air and pattern shaping air. High pressure atomization air flows from the passage 31 through two openings 63 and 64 into the groove 62. A short tube 65 is pressed or otherwise secured to project from an opening 66 in the baffle. When the baffle 49 is mounted on the gun body 12, the tube 65 extends into an opening 66' in the gun body 12 for receiving pattern shaping air. The tube 65 has a calibrated internal orifice 67 for lowering the pressure of the pattern shaping air to a desired low level. In addition, the valve needle 33 may be adjusted to further limit the flow of pattern shaping air. From the orifice 67, the pattern shaping air flows into an annular chamber 68 in the baffle 49.

From the annular groove 62, the atomization air flows through one or more calibrated small diameter pressure dropping passages 69 to an annular chamber 70 formed between the baffle 49 and the fluid tip 48. The air pressure drops as the air flows through the passages 69 to a desired low level. As the air pressure drops, its volume expands to provide the high volume low pressure air flow needed for fluid atomization. From the chamber 70, the atomization air flows through a plurality of circumferentially spaced distribution openings 71 in the fluid tip flange 56 to a chamber 72 formed between the air cap 50 and the fluid tip 48. Atomization air is discharged from an annular orifice 73 formed between an end 74 of the fluid tip 48 and the air cap 50. The discharged atomization air surrounds and atomizes the fluid as it is discharged from the orifice 61.

Figure 3:
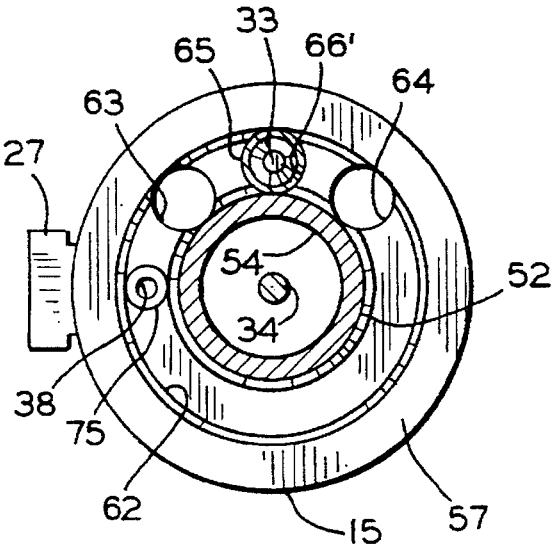
FIG. 3 is a cross sectional view as taken along line 3—3 of FIG. 2.
Figure 5:
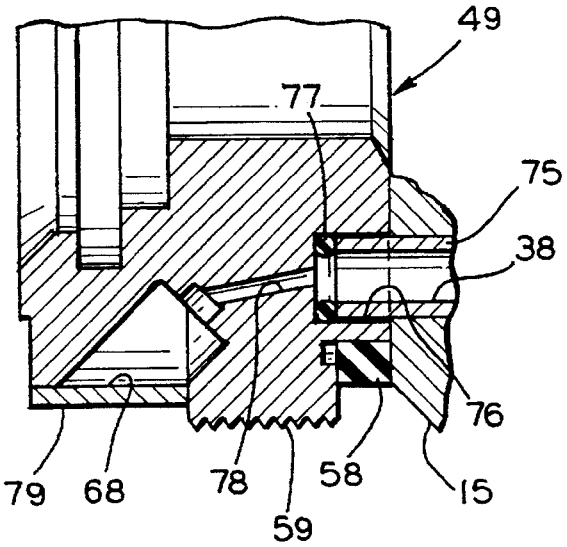
FIG. 5 is an enlarged fragmentary cross sectional view of the baffle as taken along line 5—5 of FIG. 4.
Figure 6:
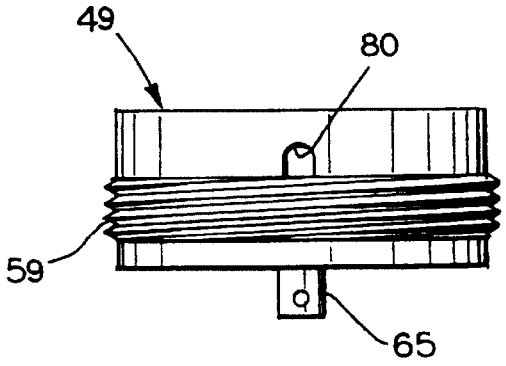
FIG. 6 is a bottom view of the baffle of FIG. 5.

As shown in FIGS. 3 and 5, a short tube 75 projects from the front face 57 on the spray gun barrel end 15. The catalyst passage 38 extends through the tube 75. When the baffle 49 is positioned against the barrel face 57, the tube 75 extends into a baffle opening 76 and is sealed by an o-ring 77. A passage 78 in the baffle 49 connects the catalyst passage 38 with the pattern shaping air chamber 68. The chamber is closed around its perimeter by a tubular sleeve 79 which is pressed onto and forms a part of the baffle 49. As shown in FIGS. 2 and 6, two notches 80 are formed in the sleeve 79 to connect the baffle chamber 68 with a chamber 81 formed between the fluid tip 48, the baffle 49, the air cap 50 and the retaining ring 51. The notches 80 are preferably located at the top and bottom of the baffle 49 and are circumferentially spaced 90° from the catalyst passage 78. This provides a tortuous flow path for the mixed catalyst and pattern shaping air, allowing the catalyst time to thoroughly mix with the pattern shaping air. Pattern shaping air passages 82 in the air cap 50 receive the pattern shaping air with the catalyst droplets from the chamber 81. The air cap 50 has two horns 83 which are spaced on diametrically opposite sides of the fluid tip end 74. The passages 82 direct the pattern shaping air/catalyst at opposite sides of the envelope of atomized fluid for flattening the envelope into a fan shaped pattern and also for contacting the atomized fluid with the catalyst externally to the spray gun 10. The air cap 50 may be rotated to provide a desires orientation to the flattened pattern. For the sake of illustration, the horns 83 are shown in a vertical arrangement, which results in a horizontal pattern. Most frequently, the horns 83 are located in a plane horizontal to the spray gun 10 to produce a vertical pattern.

The spray gun 10 is particularly useful for applying a two component water borne adhesive, such as Bondmaster adhesive sold by National Starch & Chemical Company of Bridgewater, N.J. This adhesive is a polychloroprene which is activated by citric acid. Although it is important that the atomized adhesive come into contract with the activator, the mix ratio is not as critical as with some two component materials. When a higher degree of control over the catalyst to fluid mix ration is desired, flow meters may be placed in the catalyst and fluid supply lines and the orifice 41 is eliminated from the catalyst line 26.

It will be appreciated that various modifications and changes may be made to the above described preferred embodiment of a two component external mix spray gun without departing from the spirit and the scope of the following claims. For example, as indicated above, the invention is equally applicable to a hand held spray gun as described and shown or to an automatic spray gun where the manual trigger is replaced with air and fluid valves which are operated by a controller. Although the catalyst valve 27 is illustrated as a valve secured to the side of a conventional spray gun, it will be appreciated that the catalyst valve may be formed as an integral part of the spray gun inside the gun body 12.

I claim:

1. In a two component external mix spray gun having a nozzle assembly, an air valve for controlling the flow of pattern shaping air to said nozzle assembly, a fluid valve for controlling the flow of fluid to said nozzle assembly and means for opening said air valve prior to opening said fluid valve when said spray gun is turned on and for closing said fluid valve prior to said air valve when said spray gun is turned off, the improvement comprising a fluid valve adapted to open in response to the presence of a pressurized flow of pattern shaping air to said nozzle assembly to inject catalyst into the flowing pattern shaping air in said spray gun.

2. A two component external mix spray gun, as set forth in claim 1, wherein said fluid valve is a pneumatically operated catalyst valve mounted on said spray gun, said catalyst valve having an inlet port connected to a pressurized catalyst hose, an outlet port connected to a pattern shaping air passage in said spray gun and a pilot air port connected to receive pressurized air from said air valve when said air valve is opened, said catalyst valve opening in response to pressurized air at said pilot air port.

3. A two component external mix spray gun, as set forth in claim 2, and wherein said catalyst valve is mounted on said spray gun adjacent said nozzle assembly.

4. A two component external mix spray gun, as set forth in claim 3, and further including orifice means for limiting the flow of catalyst to said nozzle assembly when said catalyst valve is opened.

5. A two component external mix spray gun, as set forth in claim 3, and wherein said spray gun is a hand held spray gun having said nozzle assembly secured to one end of a body, said body including a handle having a free end, means for securing an air hose to said handle end, a manifold secured to said handle end, said manifold having first and second passages, means securing a fluid hose to said manifold to connect to said first passage, means securing a catalyst hose to said manifold to connect to said second passage, a second fluid hose connecting from said first manifold passage to said body adjacent said nozzle assembly, and a second catalyst hose connecting from said second manifold passage to said catalyst valve inlet port.

6. A two component external mix spray gun, as set forth in claim 5, and further including orifice means in said second catalyst hose for limiting the flow of catalyst to said nozzle assembly when said catalyst valve is opened.

7. A two component external mix spray gun, as set forth in claim 6, and further including means securing said second fluid hose and said second catalyst hose together.

8. A two component external mix spray gun, as set forth in claim 1, and wherein said air valve controls the flow of pattern shaping and atomization air.

9. A spray gun for atomizing a fluid and contacting the atomized fluid with a catalyst at a location external to said spray gun, said spray gun comprising a body, a nozzle assembly secured to said body, an air valve adapted for controlling the flow of atomization and pattern shaping air to said nozzle assembly, a fluid valve adapted for controlling the flow of fluid to said nozzle assembly, triggering means for opening said air valve prior to opening said fluid valve when said spray gun is turned on and for closing said fluid valve prior to said air valve when said spray gun is turned off, a normally closed pneumatically operated catalyst valve having a pressurized catalyst inlet port and an outlet port connected to a pattern shaping air passage in said spray gun, said catalyst valve having a pilot air port connected to respond to a pressurized flow of pattern shaping air from said trigger to said nozzle to inject catalyst into the flow of pattern shaping air in said air passage in response to an increase in air pressure downstream from said air valve when said air valve is opened.

10. A method for spraying a material having first and second components comprising the steps of:

a) turning on a flow of pressurized air to a nozzle assembly, at least a portion of such flow of air shaping the pattern of atomized first material;

b) opening a pneumatically operated second material valve in response to the flow of pressurized air to said nozzle assembly to inject second material into the flow of pattern shaping air;

c) opening a first material valve after the flow of pressurized pattern shaping air is turned on to deliver first material to said nozzle assembly for atomization; and d) contacting the atomized first material with the flow of pattern shaping and second material.

* * * * *